United States Patent [19]

Taylor

[11] 4,275,995

[45] Jun. 30, 1981

[54] BILGE PUMP

[76] Inventor: Thomas K. Taylor, Eleven S. Coolidge Ave., Margate, N.J. 08402

[21] Appl. No.: 2,467

[22] Filed: Jan. 10, 1979

[51] Int. Cl.[3] ..... F04B 49/04

[52] U.S. Cl. ..... 417/40; 417/360

[58] Field of Search ..... 417/36, 40, 360, 424; 137/397, 398, 399

[56] References Cited

U.S. PATENT DOCUMENTS

| | | | |
|---|---|---|---|
| 2,697,196 | 12/1954 | Harper | 417/40 X |
| 2,829,598 | 4/1958 | Zimmermann et al. | 417/40 |
| 3,256,828 | 6/1966 | Rule | 417/424 X |
| 3,316,845 | 5/1967 | Schumann | 417/40 |
| 3,318,248 | 5/1967 | Rembold | 417/40 X |
| 3,408,942 | 11/1968 | Davenport et al. | 417/424 X |
| 4,013,383 | 3/1977 | Rule | 417/424 X |
| 4,171,186 | 10/1979 | Chapman | 417/40 X |

*Primary Examiner*—Carlton R. Croyle
*Assistant Examiner*—Edward Look
*Attorney, Agent, or Firm*—Zachary T. Wobensmith, 2nd; Zachary T. Wobensmith, III

[57] ABSTRACT

An electric motor driven bilge pump particularly for marine use is described having an outer housing of molded synthetic plastic having inlet openings for the liquid to be pumped with a bottom closure plate detachably secured thereto and a motor housing of molded synthetic plastic carried in the outer housing and containing an electric motor with a vertical shaft extending below the motor housing and having an impeller thereon, a pump housing or chamber of molded synthetic plastic carried on the lower end of the motor housing and supported and positioned in the outer housing, the outer housing having a space therein for a float operated motor controlling switch carried on the pump chamber, the motor housing having packing members for preventing leakage from the pump chamber to the motor chamber with provisions for cooling the pump bearings.

8 Claims, 7 Drawing Figures

BILGE PUMP

BACKGROUND OF THE INVENTION

1. Field of the Invention

This invention relates to electric motor driven bilge pumps.

2. Description of the Prior Art

It has heretofore been proposed to provide pumps such as are illustrated in the patents to Rule, U.S. Pat. No. 3,250,828, Davenport et al., U.S. Pat. No. 3,408,942, and Yost, U.S. Pat. No. 2,320,708 which are typical of this type of pump but do not have liquid level responsive controls, must be externally controlled, do not provide adequate motor cooling and the packings to prevent access of liquid to the motor have serious limitations in use.

Lovett, in U.S. Pat. No. 2,669,934 shows a submersible automatic bilge pump but the float mechanism is lacking in reliability with continued use, the pump rotor is of unduly limited size, and the pump requires a large number of parts.

Rachocki, in U.S. Pat. No. 3,717,420, shows a float operated thermostatically controlled reed switch for motor energization, which is however of very low pump capacity.

Rachocki, U.S. Pat. No. 3,717,420, Vigren, U.S. Pat. No. 2,264,058 and Applin, U.S. Pat. No. 3,849,771 show reed switches actuated by floats which carry magnets.

The U.S. Pat. No. 3,408,942, to Davenport, shows a pump which requires a large number of parts and has a bushing which is subject to leaks, no float operated control being shown.

Conery et al., in U.S. Pat. No. 4,001,533 show a pump with a normally open microswitch having a magnet on a spring control arm positioned by weights.

Rupp, in U.S. Pat. No. 3,746,472, shows a pump housing with attached pump chamber but the structure is complex with a multitude of parts and no associated float responsive control.

Schumann, in U.S. Pat. No. 3,316,845, shows a bilge pump with a float control but the structure has a large number of parts and would be expensive to manufacture.

The structures of the prior art patents are relatively complex with a multitude of parts, are expensive to manufacture and assemble, lack the simple float control mechanism of the present invention, do not have any comparable continuously effective packing of the pump and motor bearing as herein disclosed, and do not provide adequate motor cooling.

SUMMARY OF THE INVENTION

In accordance with the invention a bilge pump is provided with an outer molded synthetic plastic housing having inlet openings at the bottom with a bottom closure plate detachably secured thereto, a sealed motor housing of molded synthetic plastic being detachably secured in the outer housing and having an electric motor therein with a vertical shaft extending below the motor housing and having an impeller thereon, a pump chamber of molded synthetic plastic being carried on the lower end of the motor housing supported and positioned in the outer housing, the outer housing having a space therein for a float operated motor controlling switch, the motor housing having packing members for preventing leakage from the pump chamber to the motor chamber and with provisions for cooling the pump bearings.

It is the principal object of the invention to provide a bilge pump which is of simple construction, and is easy to assemble from a relatively small number of components, including molded synthetic plastic components.

It is a further object of the invention to provide a bilge pump having an outer housing with a sealed motor housing carried therein, which motor housing has a pump chamber carried on the motor housing and positioned within the outer housing.

It is a further object of the invention to provide a bilge pump having an outer housing with motor housing and pump chamber carried therein, the lower part of the outer housing having a detachably connected closure plate for access to the interior of the outer housing.

It is a further object of the invention to provide a bilge pump in which simple but effective provisions are made for preventing access of liquid from the pump chamber to the motor compartment and in which coolant is introduced through a passage between the pump chamber and motor compartment.

Other objects and advantageous features of the invention will be apparent from the description and claims.

BRIEF DESCRIPTION OF THE DRAWINGS

The nature and characteristic features of the invention will be more readily understood from the following description taken in connection with the accompanying drawings forming part hereof in which.

Figure 3:
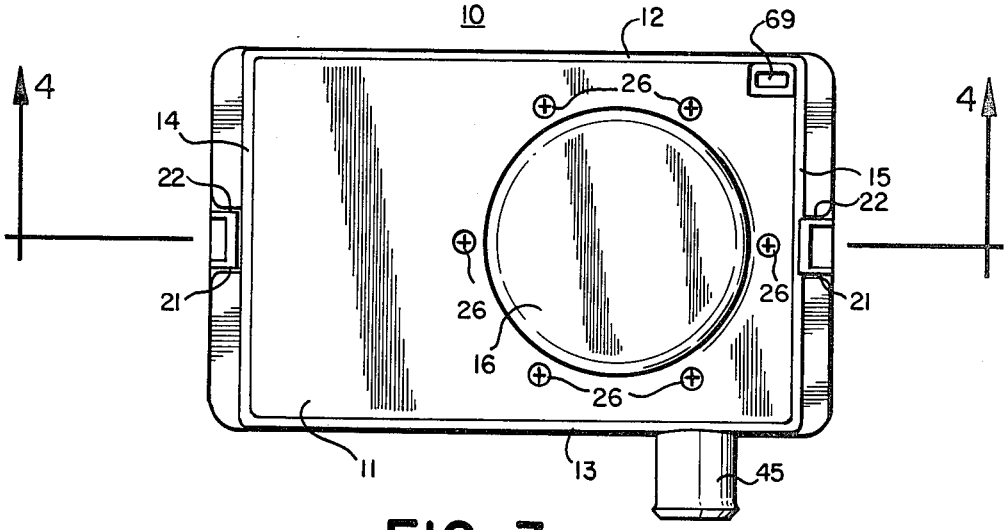
FIG. 3 is a top plan view of the pump shown in FIG. 1.
Figure 1:
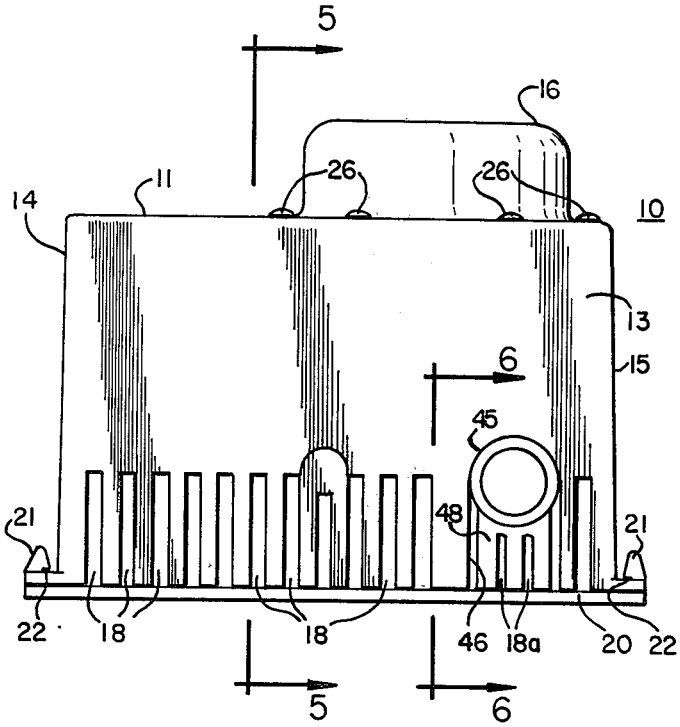
FIG. 1 is a side elevational view of a bilge pump in accordance with the invention.
Figure 2:
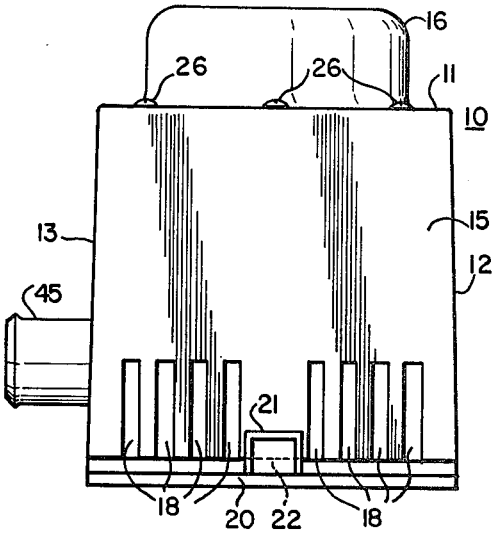
FIG. 2 is an end elevational view of the bilge pump of FIG. 1 as seen from the right end of FIG. 1.
Figure 4:
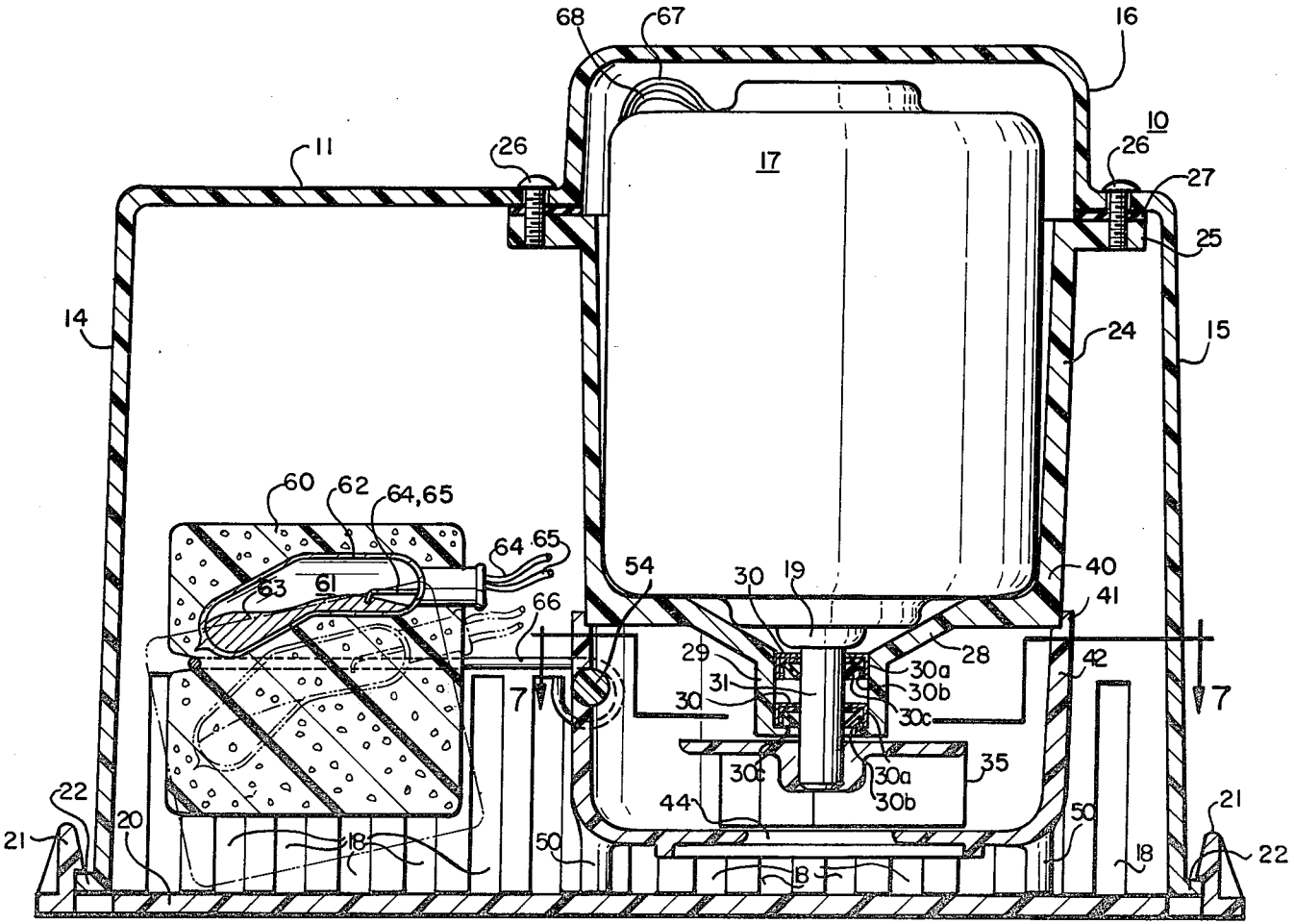
FIG. 4 is a vertical sectional view, enlarged, taken approximately on the line 4—4 of FIG. 3.
Figure 5:
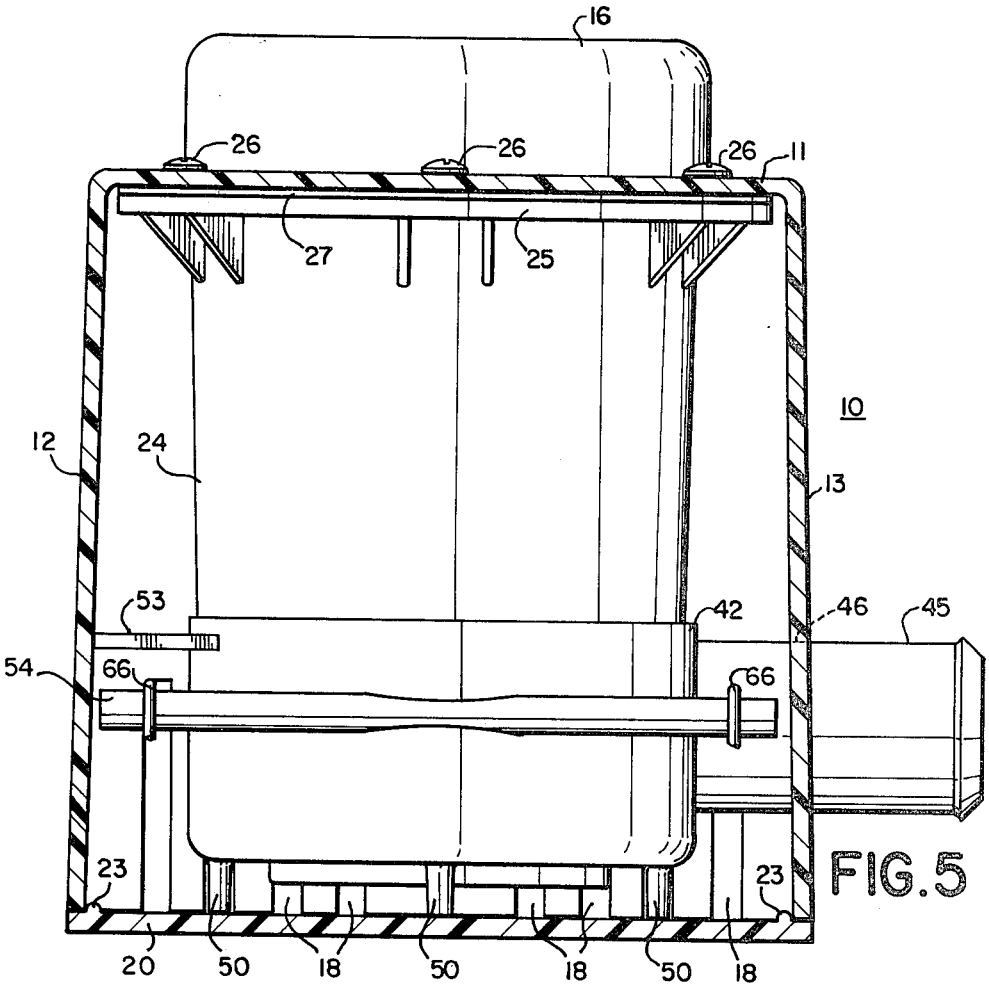
FIG. 5 is a transverse vertical sectional view, enlarged, taken approximately on the line 5—5 of FIG. 1.
Figure 6:
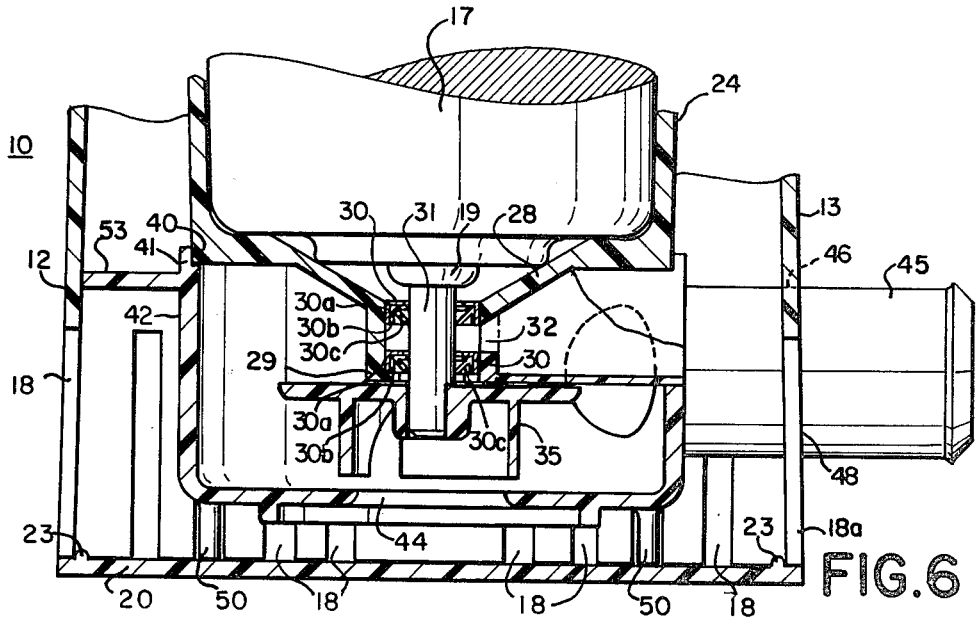
FIG. 6 is a transverse vertical sectional view, enlarged, taken approximately on the line 6—6 of FIG. 1.
Figure 7:
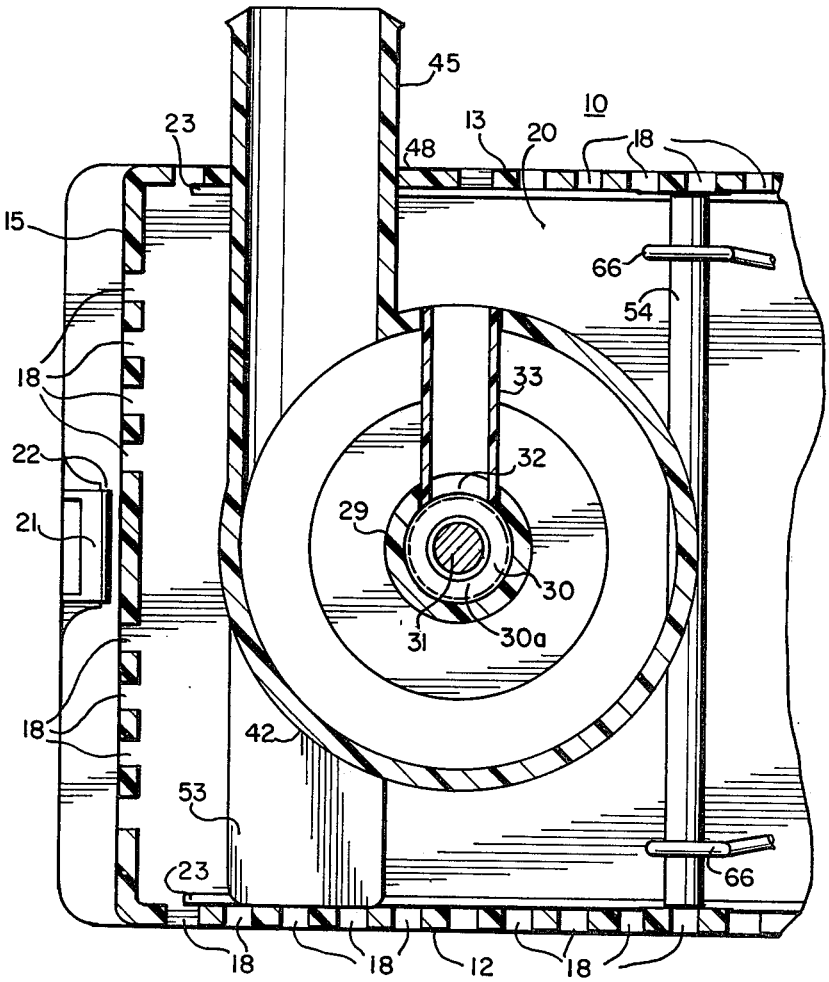
FIG. 7 is a horizontal sectional view, enlarged, taken approximately on the line 7—7 of FIG. 4.

It should, of course, be understood that the description and drawings herein are illustrative merely and that various modifications and changes can be made in the structure disclosed without departing from the spirit of the invention.

Like numerals refer to like parts throughout the several views.

DESCRIPTION OF THE PREFERRED EMBODIMENT

Referring now more particularly to the drawings the bilge pump includes an outer housing 10 preferably formed of a molded synthetic plastic material with a horizontal top wall 11, vertical side walls 12 and 13 and vertical end walls 14 and 15 with a plurality of slots 18 extending upwardly from their lower margins for liquid entry.

The top wall 12 has a domed portion 16 for reception of the upper portions of an electric motor 17 as hereinafter explained.

A bottom wall or closure portion 20 is provided formed substantially as a flat plate, detachably engaged with the bottom of the housing 10 and held by flexible tabs 21 engaged with horizontal wall portions 22 extending from the lower margins of the end walls 14 and 15. The bottom wall portion 20 has ribs 23 for relative positioning of the outer housing 10 and the bottom wall portion 20. The bottom wall portion 20 can, if desired, be secured in place in the bilge of the boat.

A molded synthetic plastic motor housing 24 is provided having a mounting rim 25 which is held in position with respect to the top wall 12 and domed portion 16 by a plurality of screws 26 in threaded engagement in the rim 25. A gasket 27 is interposed between the rim 25 and the top wall 12 to prevent fluid leakage at this location.

The electric motor 17 is carried in the motor housing 24. The housing 24 has a frustoconical lower wall portion 28 for reception of a hub 19 of the motor 17 with a cup like extension 29 therebelow for the reception of spaced sealing and aligning rings 20 through which the motor shaft 31 extends. An opening 32 at one side of the extension 29 with surrounding walls 33 extending therefrom permits of access of liquid between the rings 30 for cooling the shaft 31 and its motor bearings (not shown).

The rings 30 include mounting rings **30*a* which carry seal rings 30*b* C-shaped in cross section with horizontal portions engaging the shaft 31 and inclined portions 30*c* also engaging the shaft 31. The seal rings 30*b*** are of flexible material such as rubber, natural or synthetic.

The shaft 31 has an impeller 35 of molded synthetic plastic secured thereto for rotation therewith.

The motor housing 24 has a rim 40 with which an upper rim 41 of an impeller housing 42 is in engagement and which may, if desired, be secured by a suitable adhesive. The housing 42 has a bottom inlet opening 44 for flow of liquid to be pumped into the housing 42. A liquid delivery pipe 45 for attachment of a hose (not shown) extends from the housing 42 and is received in a slot 46 in the wall 13. A support 48 extends downwardly from the pipe 45 and has supporting legs 50 engaged by the bottom closure plate 20. The support 48 has a plurality of slots **18*a* therein similar to the slots 18. A sidewise extending arm 53 engages the wall 12 for preventing collapse of the outer housing and internal damage to the motor housing 24 when a hose is applied to the delivery pipe 45**.

The impeller housing 42 has a horizontal rod 54, serving as a fixed shaft, preferably also of synthetic plastic, carried thereby.

Within the housing 10 a float 60 is provided preferably of rigid urethane foam for buoyancy and resistance to corrosion.

The float 60 carries a mercury switch 61 which includes an outer bent tube 62 of glass with mercury 63 therein and with leads 64 and 65 extending therefrom through a groove (not shown) in the rim 25 and sealed by the gasket 27 to circuitry (not shown) is series with the pump power supply to control the operation of the motor 17.

The float 60 has arms 66 pivotally carried on the rod 44 which permits the float 60 to rise and fall with the level of the liquid in the housing 10 to be pumped.

The motor 17 has power leads 67 and 68, which with the leads 64 and 65 preferably extend outside the outer housing 10 through an opening 69 in the top wall 11 for exterior water tight connection and with the leads 64 and 65 in series in one of the power leads 67 or 68 and to the power supply.

The mode of operation will now be pointed out.

If the level of the liquid in which the bilge pump heretofore described should rise to the point where it enters the slots 18 and **18*a* in the housing 10 and the inlet opening 44 into the impeller housing 42 it will cause the float 60 to move upwardly. Such upward movement, if the liquid level rise is significant, will move the mercury 63 into contact with leads 64 and 65 to actuate the motor 17. Liquid in the impeller housing 42 will be moved by rotation of the impeller 35 for discharge through the delivery pipe 45. When the level of the liquid falls so that the float 60 moves to a position to move the mercury 63 out of contact with leads 64 and 65, rotation of the motor 7** will be discontinued until the liquid level rises again.

The upper seal of the rings 30 by reason of its disposition will prevent access of liquid to the motor 17. The lower seal will substantially reduce or prevent the flow of liquid under pressure in the impeller housing 42 so that it is not delivered through the opening 32 and surrounding walls 33, and so that the pressure in the impeller housing 42 is not applied against the upper seal. The supply of cooling fluid between the rings 33 provides simple but effective cooling of the motor bearings and seals.

I claim:

1. An electric motor driven bilge pump comprising an outer housing having top, side and end walls with fluid inlet openings at the lower part of the side walls, a bottom closure wall readily detachably secured to the bottom of said outer housing, a fixedly mounted motor housing extending downwardly within said outer housing and detachably carried by said top wall and in sealed relation to said top wall, an electric motor in said motor housing and having a downwardly extending motor shaft, seal means in said motor housing for said shaft for preventing access of liquid to said motor housing, an additional seal means in said motor housing spaced from said first mentioned seal means, said motor housing having an opening between said seal means for permitting access of liquid between said seal means for cooling, an impeller housing detachably carried on the lower end of said motor housing in spaced relation to said bottom closure wall and having a liquid inlet opening in the bottom thereof and a liquid delivery pipe extending exteriorly of said outer housing, an impeller on said motor shaft in said impeller housing, and a float controlled switch in said outer housing for said electric motor and responsive to the height of the liquid in said outer housing.

2. An electric motor driven bilge pump as defined in claim 1 in which said impeller housing has supports extending downwardly therefrom in engagement with said bottom closure wall.

3. An electric motor driven pump as defined in claim 1 in which said impeller housing is supported by legs engaging said bottom closure wall.

4. An electric motor driven pump as defined in claim 3 in which one of said supporting legs extends downwardly from said liquid delivery pipe.

5. An electric motor driven pump as defined in claim 1 in which a sidewise extending arm is provided extending from said impeller housing to one of said side walls.

6. An electric motor driven pump as defined in claim 1 in which said bottom closure wall is secured to said outer housing by flexible tabs.

7. An electric motor driven pump as defined in claim 1 in which said float controlled switch comprises a float pivotally mounted within said outer housing and a mercury switch in said float having a lower inactive position and an upper motor activating position.

8. An electric motor driven bilge pump comprising an outer housing having top, side and end walls with fluid inlet openings at the lower part thereof, a bottom closure wall for said outer housing, a motor housing within said outer housing detachably carried by said top wall and in sealed relation to said top wall, an electric motor in said motor housing and having a downwardly extending motor shaft, seal means in said motor housing for said shaft for preventing access of liquid to said motor housing, an impeller housing detachably carried on the lower end of said motor housing and having a liquid inlet opening and a liquid delivery pipe extending exteriorly of said outer housing, an impeller on said motor shaft in said impeller housing, and a float controlled switch in said outer housing responsive to the height of the liquid in said outer housing, said float controlled switch comprising a float pivotally mounted within said outer housing and a mercury switch in said float having a lower inactive position and an upper motor activating position, said float being pivotally mounted on a horizontal shaft carried by said impeller housing.

* * * * *